US009735476B2

(12) United States Patent
Liu et al.

(10) Patent No.: US 9,735,476 B2
(45) Date of Patent: Aug. 15, 2017

(54) ANTENNA APPARATUS AND THE MIMO COMMUNICATION DEVICE USING THE SAME

(71) Applicant: ACCTON TECHNOLOGY CORPORATION, Hsinchu (TW)

(72) Inventors: I-Ru Liu, Hsinchu (TW); Chih-Chang Hsieh, Hsinchu (TW); Yi-Chang Chen, Hsinchu (TW); Yang-Te Fu, Hsinchu (TW); Chang-Cheng Liu, Hsinchu (TW); Chun-Teng Hsu, Hsinchu (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 44 days.

(21) Appl. No.: 14/819,139

(22) Filed: Aug. 5, 2015

(65) Prior Publication Data

US 2016/0049736 A1 Feb. 18, 2016

Related U.S. Application Data

(60) Provisional application No. 62/038,623, filed on Aug. 18, 2014.

(51) Int. Cl.

| | |
|---|---|
| ***H01Q 21/06*** | (2006.01) |
| ***H01Q 21/28*** | (2006.01) |
| *H01Q 1/24* | (2006.01) |
| *H01Q 9/42* | (2006.01) |

(52) U.S. Cl.
CPC ..... *H01Q 21/28* (2013.01); *H01Q 1/243* (2013.01); *H01Q 9/42* (2013.01)

(58) Field of Classification Search
CPC ..... H01C 21/28; H01C 9/42; H01C 1/243
USPC ..... 343/702, 893
See application file for complete search history.

(56) References Cited

U.S. PATENT DOCUMENTS

| | | | | |
|---|---|---|---|---|
| 2007/0030208 | A1* | 2/2007 | Linehan | H01Q 1/246 343/757 |
| 2008/0074327 | A1* | 3/2008 | Noro | H01Q 9/0421 343/700 MS |
| 2010/0171674 | A1* | 7/2010 | Henderson | H01Q 21/0037 343/778 |
| 2013/0314297 | A1* | 11/2013 | Hamabe | H01Q 21/28 343/893 |
| 2014/0066757 | A1* | 3/2014 | Chayat | G01S 13/89 600/430 |
| 2014/0191918 | A1* | 7/2014 | Cheng | H01Q 5/01 343/834 |

(Continued)

*Primary Examiner* — Jessica Han
*Assistant Examiner* — Michael Bouizza
(74) *Attorney, Agent, or Firm* — Birch, Stewart, Kolasch & Birch, LLP

(57) ABSTRACT

The present invention discloses an antenna apparatus. The antenna apparatus includes a first antenna array and a second antenna array. The first antenna array includes multiple first radiating elements for transmitting radio signals of a first frequency. The second antenna array includes multiple second radiating elements for transmitting radio signals of a second frequency, wherein the first and second radiating elements are arranged in a staggered manner; wherein each of the first radiating elements is disposed between two of the second radiating elements; and wherein each of the second radiating elements is disposed between two of the first radiating elements.

15 Claims, 7 Drawing Sheets

(56) References Cited

U.S. PATENT DOCUMENTS

2014/0197998 A1* 7/2014 Govindasamy ..... H01Q 1/24
343/702

* cited by examiner

ANTENNA APPARATUS AND THE MIMO COMMUNICATION DEVICE USING THE SAME

CROSS REFERENCE TO RELATED APPLICATION

The present application is based on, and claims priority from, U.S. application Ser. No. 62/038,623, filed Aug. 18, 2014, the invention of which is hereby incorporated by reference herein in its entirety.

TECHNICAL FIELD

The technical field relates to an antenna apparatus for transmitting a first frequency and a second frequency and a multi-input multi-output (MIMO) communication device using the same, and more particularly, to an antenna apparatus which includes a first antenna array for the first frequency and a second antenna array for the second frequency.

BACKGROUND

MIMO technology utilizes antenna apparatus to receive and transmit signals, which significantly increases data throughput and coverage without additional bandwidth or transmit power, and thus plays an important role of modern wireless communication standards such as WiFi, Wimax, or 3GPP Long Term Evolution (LTE). In order to satisfy the demand of data throughput and lower bit error, lots of wireless communication equips with a MIMO antenna apparatus.

SUMMARY

An embodiment of the present invention provides an antenna apparatus. The antenna apparatus comprises a first antenna array and a second antenna array. The first antenna array comprises multiple first radiating elements, and the first antenna array is disposed on a substrate for transmitting radio signals of a first frequency. The second antenna array comprises multiple second radiating elements, and the second antenna array is disposed on the substrate for transmitting radio signals of a second frequency, wherein the first radiating elements and the second radiating elements are arranged in a staggered manner; wherein each of the first radiating elements is disposed between two of the second radiating elements; and wherein each of the second radiating elements is disposed between two of the first radiating elements.

An embodiment of the present invention provides an antenna apparatus. The antenna apparatus comprises a Bluetooth antenna, a dual-band antenna, a first antenna array, and a second antenna array. The first antenna array comprises multiple first radiating elements, and the first antenna array is disposed on a substrate for transmitting radio signals of a first frequency. The second antenna array comprises multiple second radiating elements, and the second antenna array is disposed on the substrate for transmitting radio signals of a second frequency. The Bluetooth antenna is disposed on the substrate and transmits the radio signals of the first frequency. The dual-band antenna is disposed on the substrate and transmits the radio signals of the first frequency and the second frequency, wherein the first radiating elements and the second radiating elements are disposed around the Bluetooth antenna and the dual-band antenna.

An embodiment of the present invention provides a multi-input multi-output (MIMO) communication device. The MIMO communication device comprises a signal processing unit for processing baseband signals and a transceiver for processing the baseband signals and generating radio signals. The transceiver is coupled to the signal processing unit. The transceiver comprises an antenna apparatus for transmitting/receiving the radio signals. The antenna apparatus comprises a grounding plate, a substrate, a first antenna array and a second antenna array. The substrate is disposed on the grounding plate. The first antenna array comprises multiple first radiating elements, and the first antenna array is disposed on a substrate for transmitting radio signals of a first frequency. The second antenna array comprises multiple second radiating elements, and the second antenna array is disposed on the substrate for transmitting radio signals of a second frequency, wherein the first radiating elements and the second radiating elements are arranged in a staggered manner; wherein each of the first radiating elements is disposed between two of the second radiating elements; and wherein each of the second radiating elements is disposed between two of the first radiating elements.

BRIEF DESCRIPTION OF THE DRAWINGS

The present invention can be more fully understood by reading the subsequent detailed description and examples with references made to the accompanying drawings, wherein.

DETAILED DESCRIPTION

The following description is of the best-contemplated mode of carrying out the present invention. This description is made for the purpose of illustrating the general principles of the present invention and should not be taken in a limiting sense. The scope of the present invention is best determined by reference to the appended claims.

Figure 1:
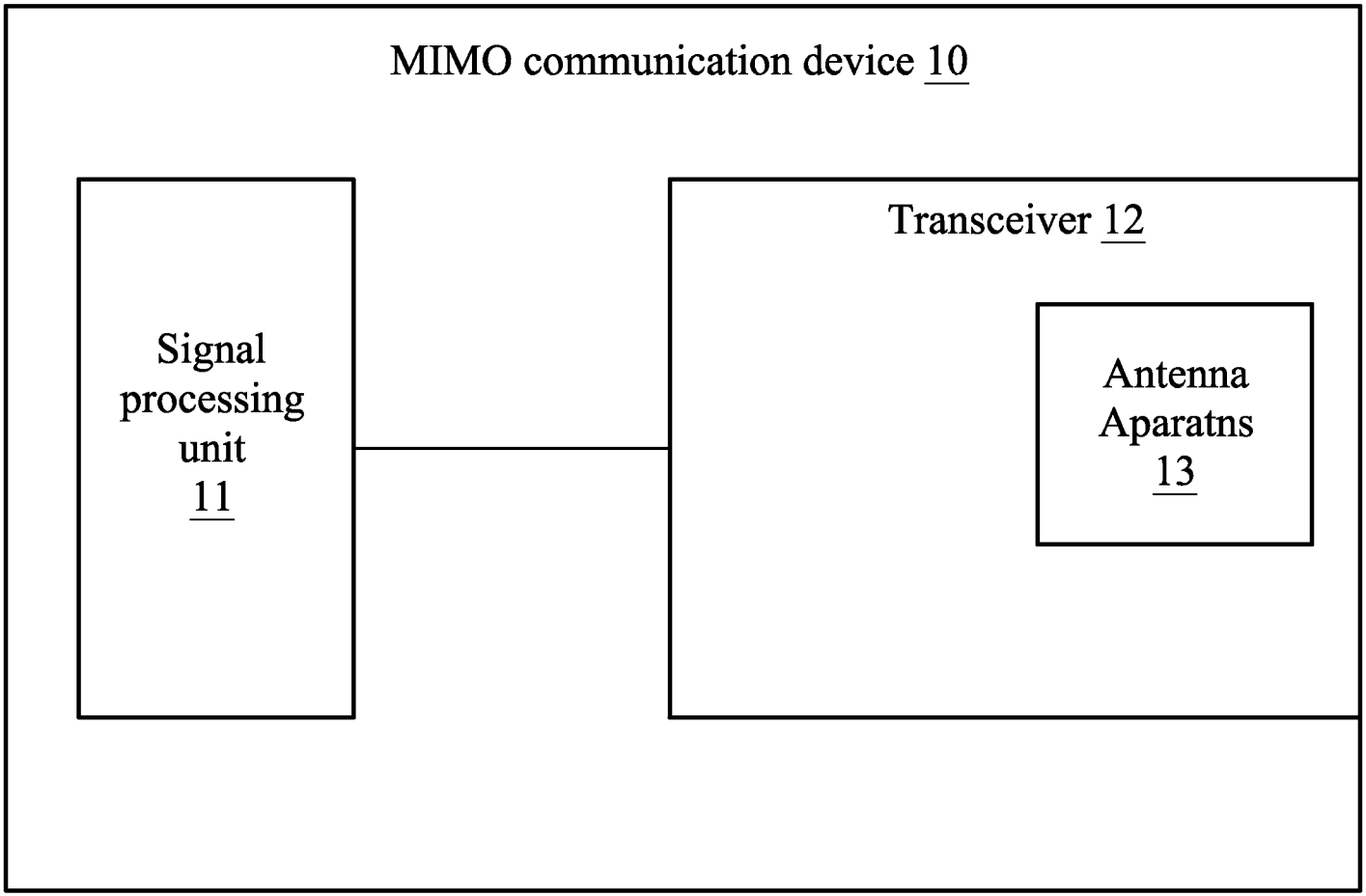
FIG. 1 is a block diagram showing a multi-input multi-output (MIMO) communication device 10 according to a first embodiment of the present invention.

FIG. 1 is a block diagram showing a multi-input multi-output (MIMO) communication device 10 according to a first embodiment of the present invention. In the first embodiment, MIMO communication device 10 comprises a signal processing unit 11 and a transceiver 12. Signal processing unit 11 processes baseband signals. Transceiver 12 is coupled to signal processing unit 11. Transceiver 12 processes the baseband signals received from signal processing unit 11 and generates the corresponding radio signals for transmitting. Transceiver 12 also receives radio signals and generates the corresponding baseband signals to signal processing unit 11. Transceiver 12 comprises an antenna apparatus 13 for transmitting/receiving the radio signals. In the first embodiment, MIMO communication device 10 is an access point device and the antenna apparatus 13 is a MIMO antenna apparatus.

Figure 2A:
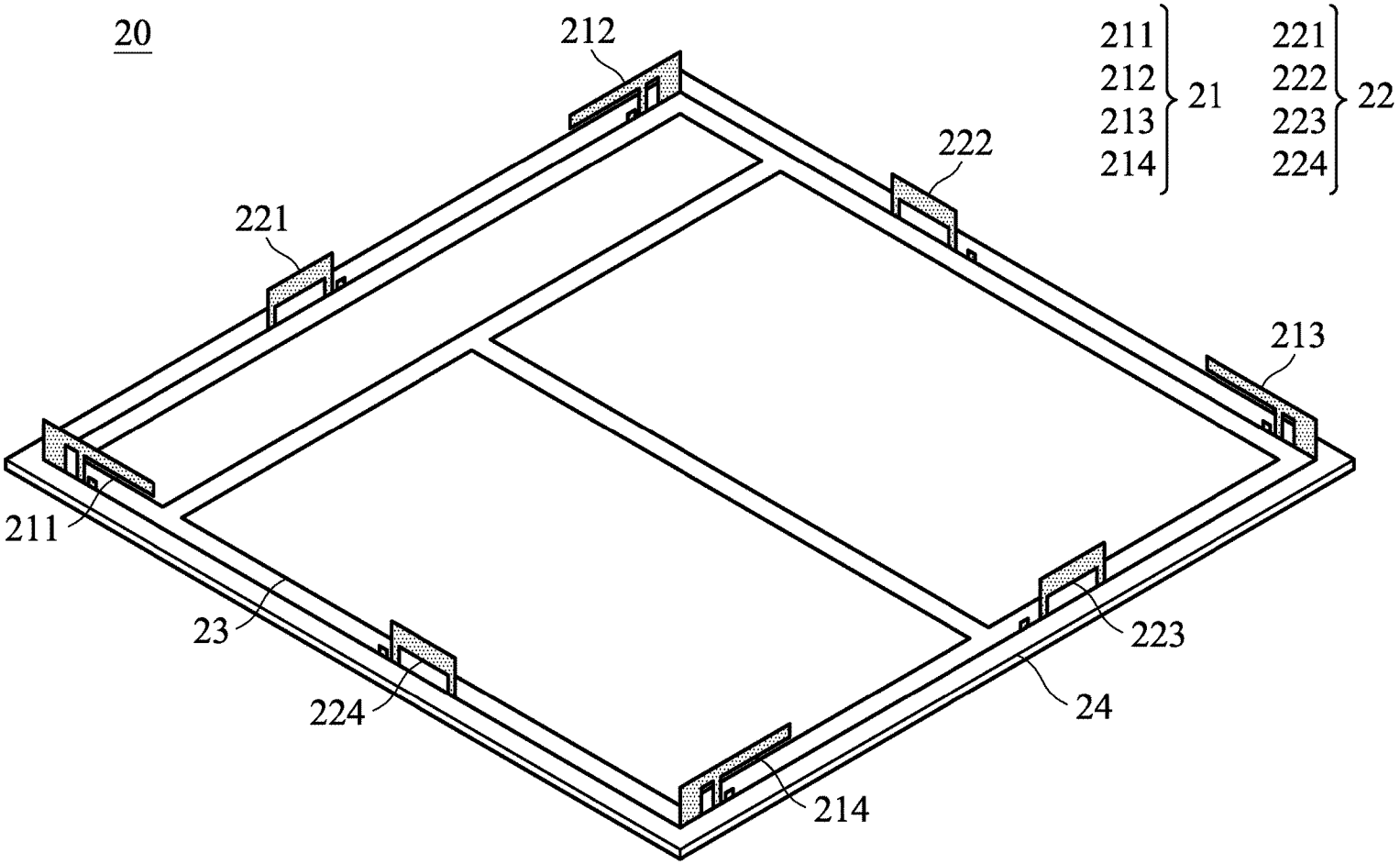
FIG. 2A is a schematic diagram showing an antenna apparatus 20 according to a second embodiment of the present invention.

FIG. 2A is a schematic diagram showing an antenna apparatus 20 according to a second embodiment of the present invention. In the second embodiment, antenna apparatus 20 comprises a first antenna array 21, a second antenna array 22, a substrate 23, and a grounding plate 24. The first antenna array 21 and the second antenna array 22 are disposed on the substrate 23. The substrate 23 is disposed on the grounding plate 24. The first antenna array 21 comprises a first radiating element 211, a first radiating element 212, a first radiating element 213, and a first radiating element 214. The second antenna array 22 comprises a second radiating element 221, a second radiating element 222, a second radiating element 223, and a second radiating element 224.

In the second embodiment, the first radiating elements 211-214 are used to transmit/receive radio signals of a first frequency and the first frequency is 2.4 GHz. The second radiating elements 221-224 are used to transmit/receive radio signals of a second frequency and the second frequency is 5 GHz. In the second embodiment, the first radiating elements 211-214 and the second radiating elements 221-224 support WiFi or Bluetooth. The first radiating elements 211-214 and the second radiating elements 221-224 are single-band radiating elements, and thus the antenna apparatus 20 of the second embodiment supports 4×4 MIMO communication system. In the second embodiment, the length, width and height of the grounding plate 24, for example, are respectively 130 mm×130 mm×1.6 mm. The length and width of the substrate 23, for example, is respectively 110 mm×110 mm. The length, width and height of the antenna apparatus 20, for example, are respectively 130 mm×130 mm×10.5 mm. Therefore the antenna apparatus 20 of the second embodiment can be integrated/utilized in most of wireless access point devices under miniaturization requirement.

In the second embodiment, the first radiating elements 211-214 and the second radiating elements 221-224 are an inverse F antenna (IFA). Because the antenna apparatus 20 of the present invention is applied in a wireless access point device, the lengths of the first radiating elements 211-214 and the second radiating elements 221-224 are respectively selected to be ¼ waveform length with its corresponding transmitting radio frequency. But the present invention is not limited thereto, the first radiating elements 211-214 and second radiating elements 221-224 can be monopole antenna with ¼ waveform length of corresponding transmitting radio frequency, dipole antenna with ¼ waveform length of corresponding transmitting radio frequency, or patch antenna with ½ waveform length of corresponding transmitting radio frequency, wherein the patch antenna is less recommended. In the second embodiment, the length of the first radiating elements 211-214, for example, is 33 mm and the length of the second radiating elements 221-224, for example, is 19 mm, but the present invention is not limited thereto.

In the second embodiment of FIG. 2A, the first radiating elements 211-214 and the second radiating elements 221-224 are arranged in a staggered manner, wherein each of the first radiating elements 211-214 is disposed between two of the second radiating elements 221-224 and wherein each of the second radiating elements 221-224 is disposed between two of the first radiating elements 211-214. In the second embodiment, the substrate 23 is a single square metallic frame. Thus all the eight antennas with totally eight antenna ports are integrated on the single metallic frame. In the second embodiment, the single square metallic frame has rivet holes for being fixed on the grounding plate 24 (not shown in FIG. 2), and the single square metallic frame has wire assemblies which are laid out either on the front or reverse sides of the grounding plate 24. In the second embodiment, all of the first radiating elements 211-214, the second radiating elements 221-224, the single square metallic frame, and the grounding plate 24 are of metal-work for heat dissipation and thus can be tooled by punching or stamping. In the second embodiment, the antenna apparatus 20 is installed on the reverse side of a PCB board of an access point device using the antenna apparatus 20 for EMI isolation. In the second embodiment, there are no additional co-planar grounding plates except ground plane under the supporting frame. This makes each antenna possesses radiation pattern as omni as possible for uniformly covering the half space. This is important for the applications of MIMO and multi-user MIMO as well. In another embodiment of the present invention, the metallic frame further provides rivet holes prepared for being body-fixed on a separate grounding plate in mechanical assembly. That separate grounding plate can be optionally co-structured with system thermal radiator and EMI isolator for size saving and weight reducing, and for cost down surely.

In another embodiment of the present invention, antennas feeds and cable assemblies are all at same side of the metallic frame and never across the bottom of the metallic frame. Cable holding clippers are then to be placed on the antenna-frame side of the grounding plate. Each cable assembly routes to the respective RF block in a loose group or a tight harness, with length as short as possible. The design is good for the purpose of enhancement of system interference immunity (because the wires and circuitry are separated by the metallic plate with a large area). The Absorbers on the other side then have a great chance to be omitted. Hence integrated multiple antennas can be IQC tested in advance. BOM and assembly costs are reduced. Both quality and reliability should be accordingly conserved to the best.

In the second embodiment of FIG. 2A, the first radiating elements 211-214 and the second radiating elements 221-224 are placed around the square area disclosed in FIG. 2A and by the four edges and at the four corner of that square. In other words, the first radiating elements 211-214 are disposed on each corner of the square metallic frame, and the second radiating elements 221-224 are disposed on each side of the square metallic frame. Practically, the positions of the first radiating elements 211-214 and the second radiating elements 221-224 can be mutually exchangeable in group.

In the second embodiment of FIG. 2A, each antenna has sufficient spacing apart from adjacent antennas to keep cross-band isolation for EMC consideration. For example, the first radiating element 211 has sufficient spacing apart from adjacent second radiating elements 221 and 224 to keep cross-band isolation for EMC consideration. For example, the second radiating elements 222 has sufficient spacing apart from adjacent first radiating elements 212 and 213 to keep cross-band isolation for EMC consideration.

In the second embodiment of FIG. 2A, each antenna has much more spacing apart from the antennas to keep co-band isolation for MIMO consideration. For example, the first radiating element 211 has much more spacing apart from the first radiating elements 212 and 214 to keep co-band isolation for MIMO consideration. For example, the second radiating element 223 has much more spacing apart from the second radiating elements 222 and 224 to keep co-band isolation for MIMO consideration. In the second embodiment of FIG. 2A, each antenna crosses the orientation with two neighbored co-band antennas for enhancing the correlation coefficient of the 4×4 MIMO communication system. For example, the orientation of the first radiating element 211 is substantially perpendicular to the orientations of two adjacent first radiating elements 212 and 214, but the present invention is not limited thereto. Sufficient spacing plus crossed orientation has the benefit of increasing diversity gain of the first and second radiating elements for strengthening MIMO communication system immunity of channel deep fades.

In the second embodiment of FIG. 2A, the 2.4 GHz band antenna (i.e. first radiating elements 211-214) is placed further near the 5 GHz band antenna (i.e. second radiating elements 221-224) than the 2.4 GHz band antenna for coexistence. In other words, the distance between the first radiating element and the corresponding nearest second radiating element is less than the smallest distance of any two of the first radiating elements. For example, the first radiating elements 211 of the first antenna array 21 is placed further near the second radiating element 221 of the second antenna array 22 than the first radiating elements 212 or the first radiating elements 214 of the first antenna array 21. All the efforts are to higher the co-band isolation of the antenna apparatus 20.

According to the above placing principle of the second embodiment, the distance between the first radiating elements 211 and the second radiating elements 221, for example, is 22 mm. The distance between the first radiating elements 212 and the second radiating elements 222, the distance between the first radiating elements 213 and the second radiating elements 223 and the distance between the first radiating elements 214 and the second radiating elements 224, for example, are also 22 mm. According to the above placing principle of the second embodiment, the distance between the first radiating elements 211 and the second radiating elements 224, for example, is 35 mm. The distance between the first radiating elements 212 and the second radiating elements 221, the distance between the first radiating elements 213 and the second radiating elements 222 and the distance between the first radiating elements 214 and the second radiating elements 223, for example, are also 35 mm. Then comparing with placing the second radiating elements 221~224 at the middle of the each side of the metallic frame, the above placing principle allows the second radiating elements 221~224 to surround a larger area. Hence the second radiating elements 221~224 arranged with the above placing principle have more space apart from each other.

In addition, it is notable that the antenna apparatus 20 of the second embodiment do not support or place any isolator inside and retains cross-band isolation within the square area. That is because placing isolators will affect/shield the 4×4 MIMO communication with some client stations.

Figure 2B:
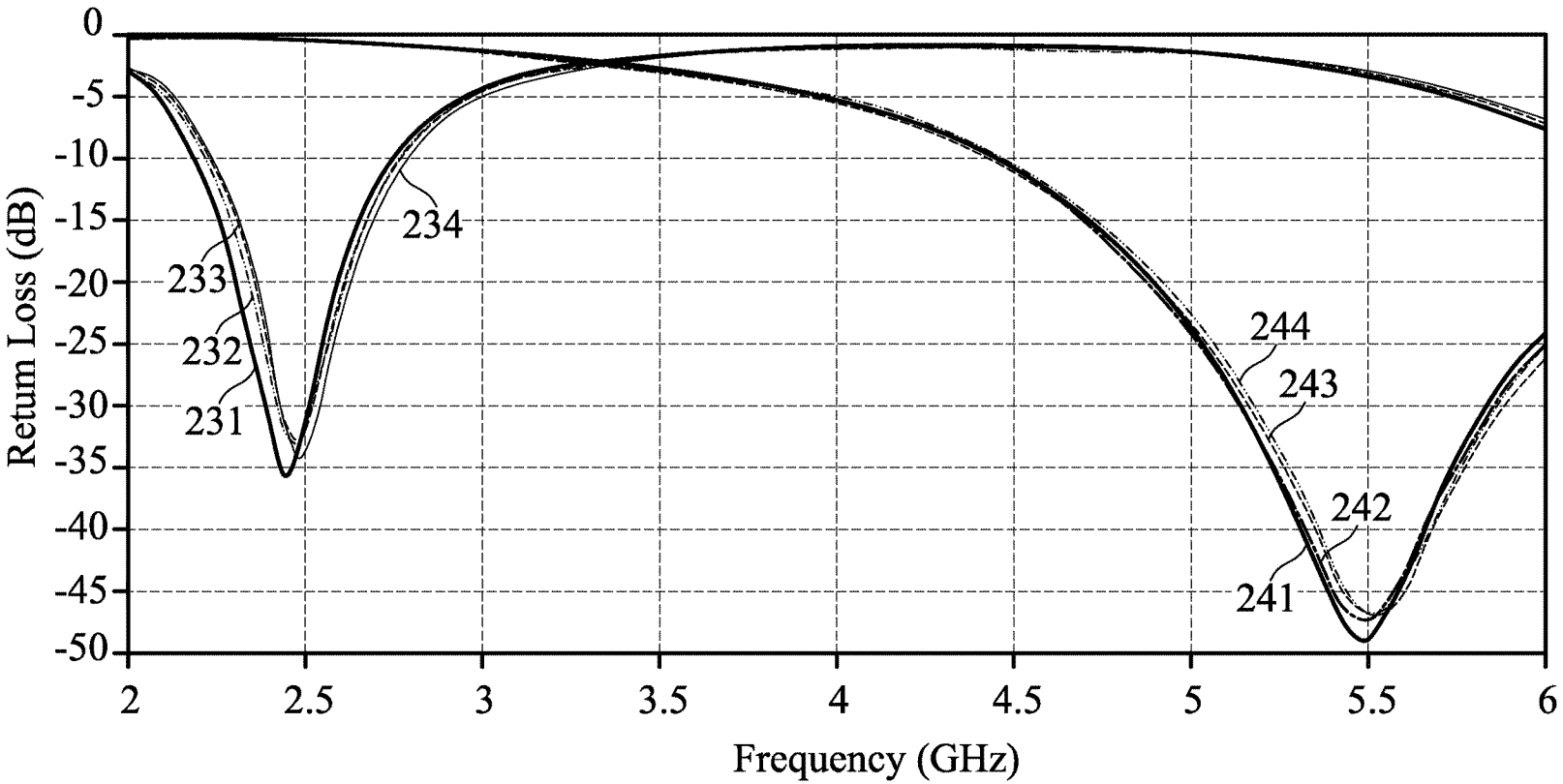
FIG. 2B is a simulation showing the return loss of the radiating elements of the antenna apparatus 20 disclosed in the second embodiment.

FIG. 2B is a simulation showing the return loss of the radiating elements of the antenna apparatus 20 disclosed in the second embodiment, wherein the X-axis represents operation frequency and the Y-axis represents the magnitude of return loss in dB. In telecommunications, return loss is the loss of power in the signal returned/reflected by a discontinuity in a transmission line or optical fiber. This discontinuity can be a mismatch with the terminating load or with a device inserted in the line. It is usually expressed as a ratio in decibels (dB). In FIG. 2B, lines 231~234 respectively show the return loss of the first radiating elements 211~214, and lines 241~244 respectively show the return loss of the second radiating elements 221~224. According to the simulation results, the first radiating elements 211~214 have well performance at 2.3 GHz~2.8 GHz, and the second radiating elements 221~224 have well performance at 5 GHz~6 GHz. Hence the first radiating elements 211~214 can be used to transmit/receive radio signals of the first frequency (2.4 GHz), and the second radiating elements 221~224 also can be used to transmit/receive radio signals of the second frequency (5 GHz).

Figure 3A:
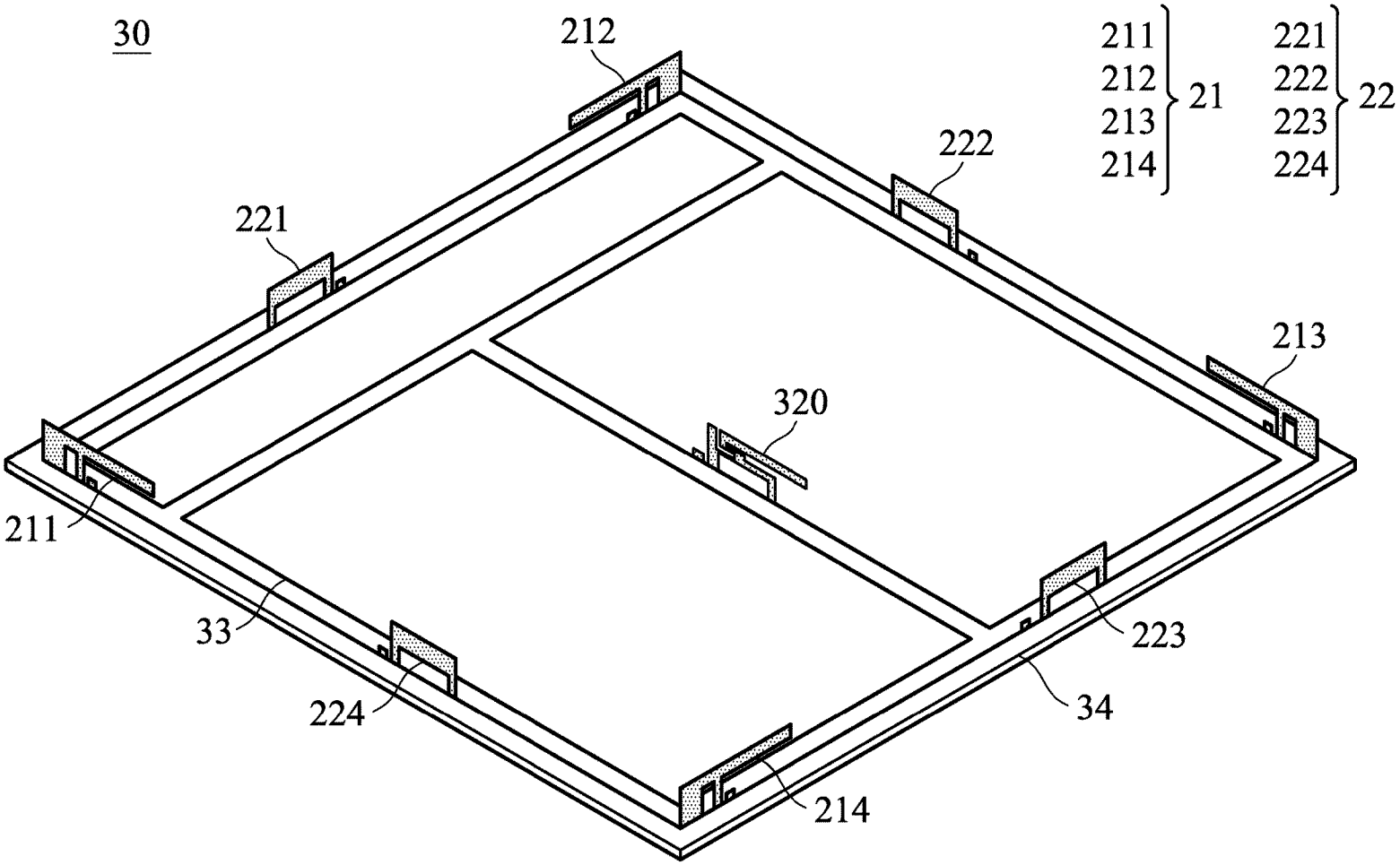
FIG. 3A is a schematic diagram showing an antenna apparatus 30 according to a third embodiment of the present invention.

FIG. 3A is a schematic diagram showing an antenna apparatus 30 according to a third embodiment of the present invention. In the third embodiment, antenna apparatus 30 comprises the first antenna array 21, the second antenna array 22, a dual-band antenna 320, a substrate 33, and a grounding plate 34. The first antenna array 21 and the second antenna array 22 are disposed on the substrate 33. The substrate 33 is disposed on the grounding plate 34. In the third embodiment, the first radiating elements 211-214, the second radiating elements 221-224, and the dual-band antenna 320 support WiFi or Bluetooth transmission. The antenna apparatus 30 of the third embodiment supports 4×4 MIMO communication system. In the third embodiment, the length, width and height of the grounding plate 34, for example, are respectively 160 mm×160 mm×1.6 mm. The length and width of the substrate 33, for example, is respectively 150 mm×150 mm. The length, width and height of the antenna apparatus 30, for example, are respectively 160 mm×160 mm×10.5 mm. Therefore the antenna apparatus 30 of the third embodiment can be integrated/utilized in most of wireless access point devices under miniaturization requirement.

In the third embodiment, the dual-band antenna 320 is a planar inverse F antenna (PIFA). Because the antenna apparatus 30 of the present invention is applied in a wireless access point device, the length of the dual-band antenna 320 is selected to be ¼ waveform length with its corresponding transmitting radio frequency. But the present invention is not limited thereto, the dual-band antenna 320 can be monopole antenna with ¼ waveform length of corresponding transmitting radio frequency, dipole antenna with ¼ waveform length of corresponding transmitting radio frequency, or patch antenna with ½ waveform length of corresponding transmitting radio frequency, wherein the patch antenna is less recommended.

In the third embodiment, the placing principle of the first radiating elements 211-214 and the second radiating elements 221-224 follows the placing principle of the first radiating elements 211-214 and the second radiating elements 221-224 of the second embodiment. In the third embodiment, the substrate 33 is a single square metallic frame. Thus all the nine antennas (the first radiating elements 211-214, the second radiating elements 221-224, and the dual-band antenna 320) with totally ten antenna ports are integrated on the single metallic frame In the third embodiment, the single square metallic frame has rivet holes for being fixed on the grounding plate 34 (not shown in FIG. 3), and the single square metallic frame has wire assemblies which are laid out either on the front or reverse sides of the grounding plate 34. In the third embodiment, all of the first radiating elements 211-214, the second radiating elements 221-224, the dual-band antenna 320, the single square metallic frame, and the grounding plate 34 are of metal-work for heat dissipation and thus can be tooled by punching or stamping. In the third embodiment, the antenna apparatus 30 is installed on the reverse side of a PCB board of an access point device using the antenna apparatus 30 for EMI isolation. In the third embodiment, there are no additional co-planar grounding plates except ground plane under the supporting frame. This makes each antenna possesses radiation pattern as omni as possible for uniformly covering the half space. This is important for the applications of MIMO and multi-user MIMO as well.

In the third embodiment, the dual-band antenna 320 is used as a scanning antenna. For example, the dual-band antenna 320 is used to search available links before the MIMO communication works. In other words, the dual-band antenna 320 plays the role of discovering radio sent from client stations before the first radiating elements 211-214 and the second radiating elements 221-224 proceed WiFi link communication. For example, the dual-band antenna 320 is used to find whether a rogue AP exist in the wireless communication or not. In the third embodiment, the dual-band antenna 320 is surrounded by the first radiating elements 211-214 and the second radiating elements 221-224, and the dual-band antenna 320 is disposed on the single square metallic frame and in the center of the square area disclosed in FIG. 3A. The reason why putting the dual-band antenna 320 at the frame center is for giving an position with equal view around omni-directions to the scanning antenna (dual-band antenna 320) which takes the responsibility to scan, sniff, or take cognition on the management frames which sent from all client stations around host station of own access point, on the first stage of WiFi link process. In addition, comparing the above placing principle of the second radiating elements 221~224 shown in the second embodiment with placing the second radiating elements 221~224 at the middle of the each side of the metallic frame, the above placing principle allows the second radiating elements 221~224 to have more space apart the dual-band antenna 320.

In addition, it is notable that the antenna apparatus 30 of the third embodiment do not support or place any isolator inside and retains cross-band isolation within the square area. That is because placing isolators will affect/shield the 4×4 MIMO communication with some client stations.

Figure 3B:
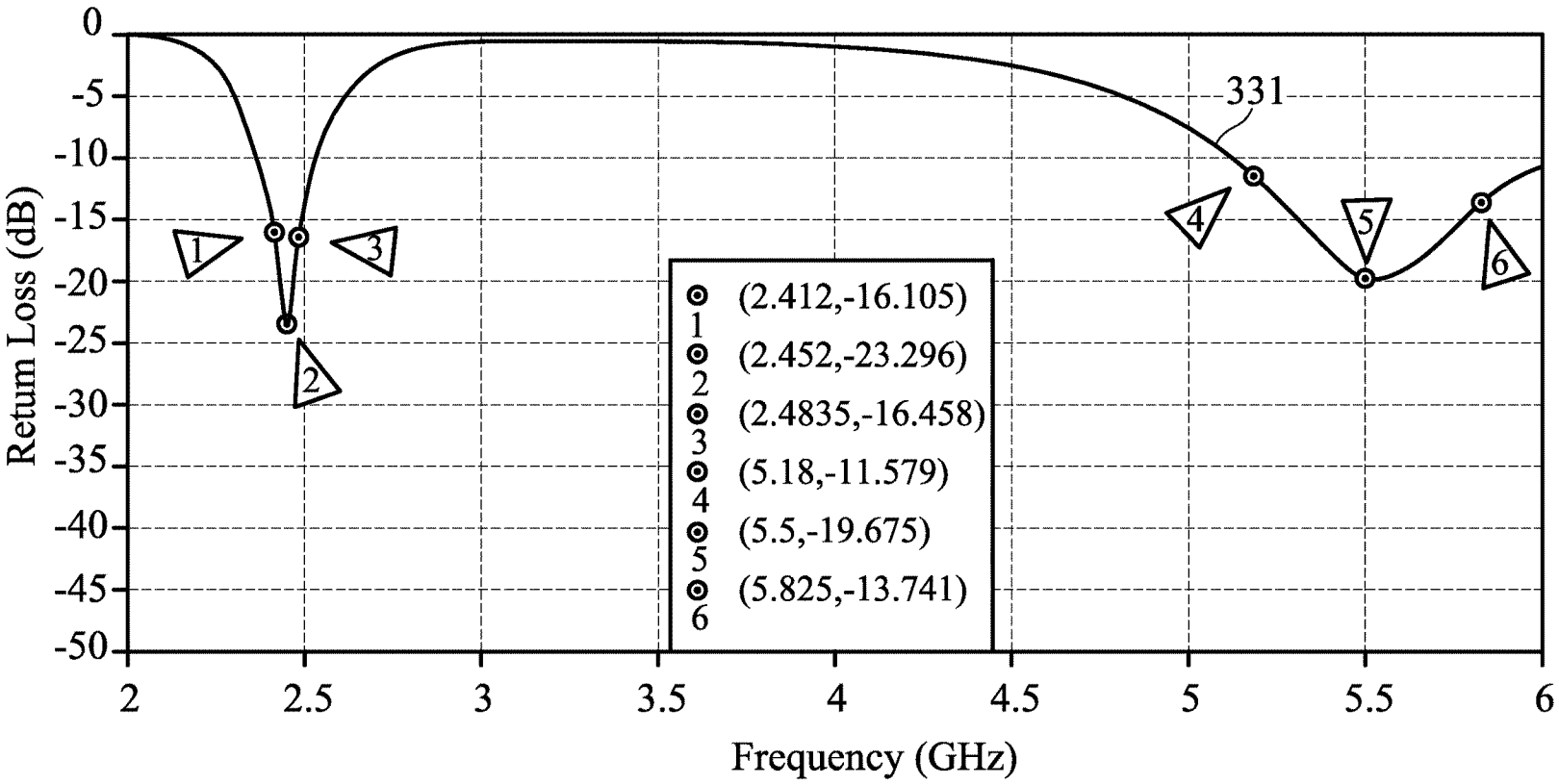
FIG. 3B is a simulation showing the return loss of the dual-band antenna 320 of the antenna apparatus 30 disclosed in the third embodiment.

FIG. 3B is a simulation showing the return loss of the dual-band antenna 320 of the antenna apparatus 30 disclosed in the third embodiment, wherein the X-axis represents operation frequency and the Y-axis represents the magnitude of return loss in dB. In FIG. 3B, line 331 shows the return loss of the dual-band antenna 320. According to the simulation results, when the operation frequencies are respectively at 2.412 GHz, 2.452 GHz, and 2.4835 GHz, the return loss of the dual-band antenna 320 are respectively −16.105 dB, −23.296 dB, and −16.458 dB. When the operation frequencies are respectively at 5.18 GHz, 5.5 GHz, and 5.825 GHz, the return loss of the dual-band antenna 320 are respectively −11.579 dB, −19.675 dB, and −13.741 dB. Hence the dual-band antenna 320 can be used to transmit/receive radio signals of the first frequency (2.4 GHz) and the second frequency (5 GHz).

Figure 4A:
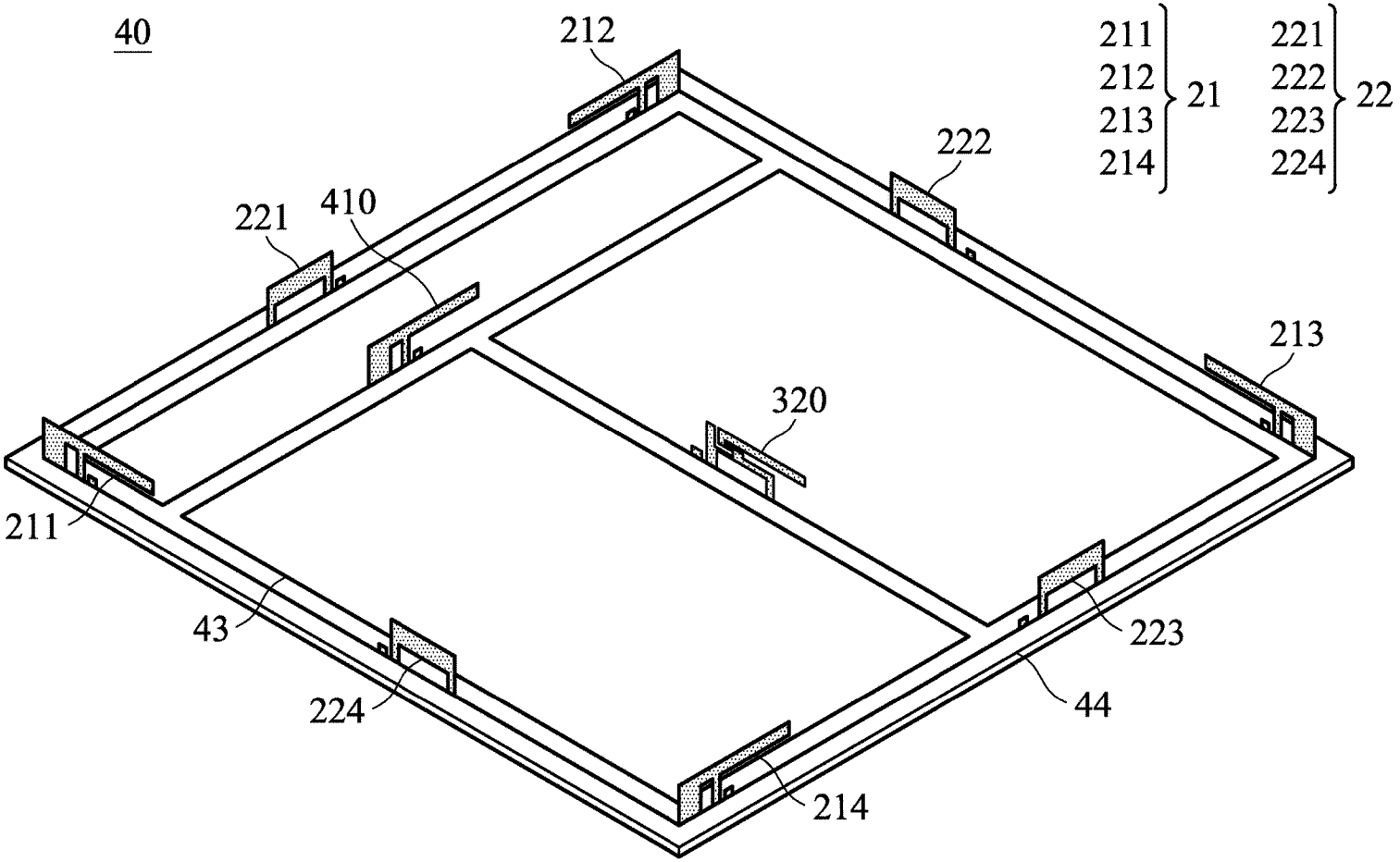
FIG. 4A is a schematic diagram showing an antenna apparatus 40 according to a fourth embodiment of the present invention.

FIG. 4A is a schematic diagram showing an antenna apparatus 40 according to a fourth embodiment of the present invention. In the fourth embodiment, antenna apparatus 40 comprises the first antenna array 21, the second antenna array 22, a Bluetooth antenna 410, the dual-band antenna 320, a substrate 43, and a grounding plate 44. The first antenna array 21 and the second antenna array 22 are disposed on the substrate 33. The substrate 43 is disposed on the grounding plate 44.

In the fourth embodiment, the Bluetooth antenna 410 is used to transmit/receive 2.4 GHz radio signals. In the fourth embodiment, the first radiating elements 211-214, the second radiating elements 221-224, and the dual-band antenna 320 support WiFi or Bluetooth transmission, but the Bluetooth antenna 410 only supports Bluetooth transmission. The antenna apparatus 40 of the fourth embodiment supports 4×4 MIMO communication system. In the fourth embodiment, the length, width and height of the grounding plate 44, for example, are respectively 200 mm×200 mm×1.6 mm. The length and width of the substrate 43, for example, is respectively 190 mm×190 mm. The length, width and height of the antenna apparatus 40, for example, are respectively 200 mm×200 mm×10.5 mm. Therefore the antenna apparatus 40 of the fourth embodiment can be integrated/utilized in most of wireless access point devices under miniaturization requirement.

In the fourth embodiment, the Bluetooth antenna 410 is an inverse F antenna (IFA). Because the antenna apparatus 40 of the present invention is applied in a wireless access point device, the length of the Bluetooth antenna 410 is selected to be ¼ waveform length with its corresponding transmitting radio frequency. But the present invention is not limited thereto, the Bluetooth antenna 410 can be monopole antenna with ¼ waveform length of corresponding transmitting radio frequency, dipole antenna with ¼ waveform length of corresponding transmitting radio frequency, or patch antenna with ½ waveform length of corresponding transmitting radio frequency, wherein the patch antenna is less recommended.

In the fourth embodiment, the placing principle of the first radiating elements 211-214 and the second radiating elements 221-224 follows the placing principle of the first radiating elements 211-214 and the second radiating elements 221-224 of the second embodiment. In the fourth embodiment, the substrate 43 is a single square metallic frame. Thus all the ten antennas (the first radiating elements 411-414, the second radiating elements 421-424, the Bluetooth antenna 410, the dual-band antenna 320) with totally eleven antenna ports are integrated on the single metallic frame. In the fourth embodiment, the single square metallic frame has rivet holes for being fixed on the grounding plate 44 (not shown in FIG. 4), and the single square metallic frame has wire assemblies which are laid out either on the front or reverse sides of the grounding plate 44. In the fourth embodiment, all of the first radiating elements 211-214, the second radiating elements 221-224, the Bluetooth antenna 410, the dual-band antenna 320, the single square metallic frame, and the grounding plate 44 are of metal-work for heat dissipation and thus can be tooled by punching or stamping. In the fourth embodiment, the antenna apparatus 40 is installed on the reverse side of a PCB board of an access point device using the antenna apparatus 40 for EMI isolation. In the fourth embodiment, there are no additional co-planar grounding plates except ground plane under the supporting frame. This makes each antenna possesses radiation pattern as omni as possible for uniformly covering the half space. This is important for the applications of MIMO and multi-user MIMO as well.

In the fourth embodiment, the Bluetooth antenna 410 is surrounded by the first radiating elements 211-214 and the second radiating elements 221-224, and the Bluetooth antenna 410 is disposed on the single square metallic frame shown in FIG. 4A. In the fourth embodiment, the Bluetooth antenna 410 may cross the omni-orientation together with the dual-band antenna 320, and the Bluetooth antenna 410 can be substantially perpendicular to the dual-band antenna 320.

In the fourth embodiment, the Bluetooth antenna 410 is used to apply in an allocation base station. For example, the Bluetooth antenna 410 can interact with the Bicon to get the indoor location information of customers. In the fourth embodiment, the dual-band antenna 320 is used as a scanning antenna. For example, the dual-band antenna 320 is used to search available links before the MIMO communication works. In other words, the dual-band antenna 320 plays the role of discovering radio sent from client stations before the first radiating elements 211-214 and the second radiating elements 221-224 proceed WiFi link communication. For example, the dual-band antenna 320 is used to find whether a rogue AP exist in the wireless communication or not. In addition, it is notable that the antenna apparatus 40 of the fourth embodiment do not support or place any isolator inside and retains cross-band isolation within the square area. That is because placing isolators will affect/shield the 4×4 MIMO communication with some client stations. Since the Bluetooth antenna 410 uses 2.4 GHz band, it is then placed rather near 5 GHz band antennas (i.e. second radiating elements 221-224) than the antennas of same frequency of WiFi (i.e. first radiating elements 211-214) for coexistence reason. In addition, the Bluetooth antenna 410 crosses the orientation with the adjacent dual-band antenna 320 for scanning radio. All the efforts are to higher the co-band isolation.

Figure 4B:
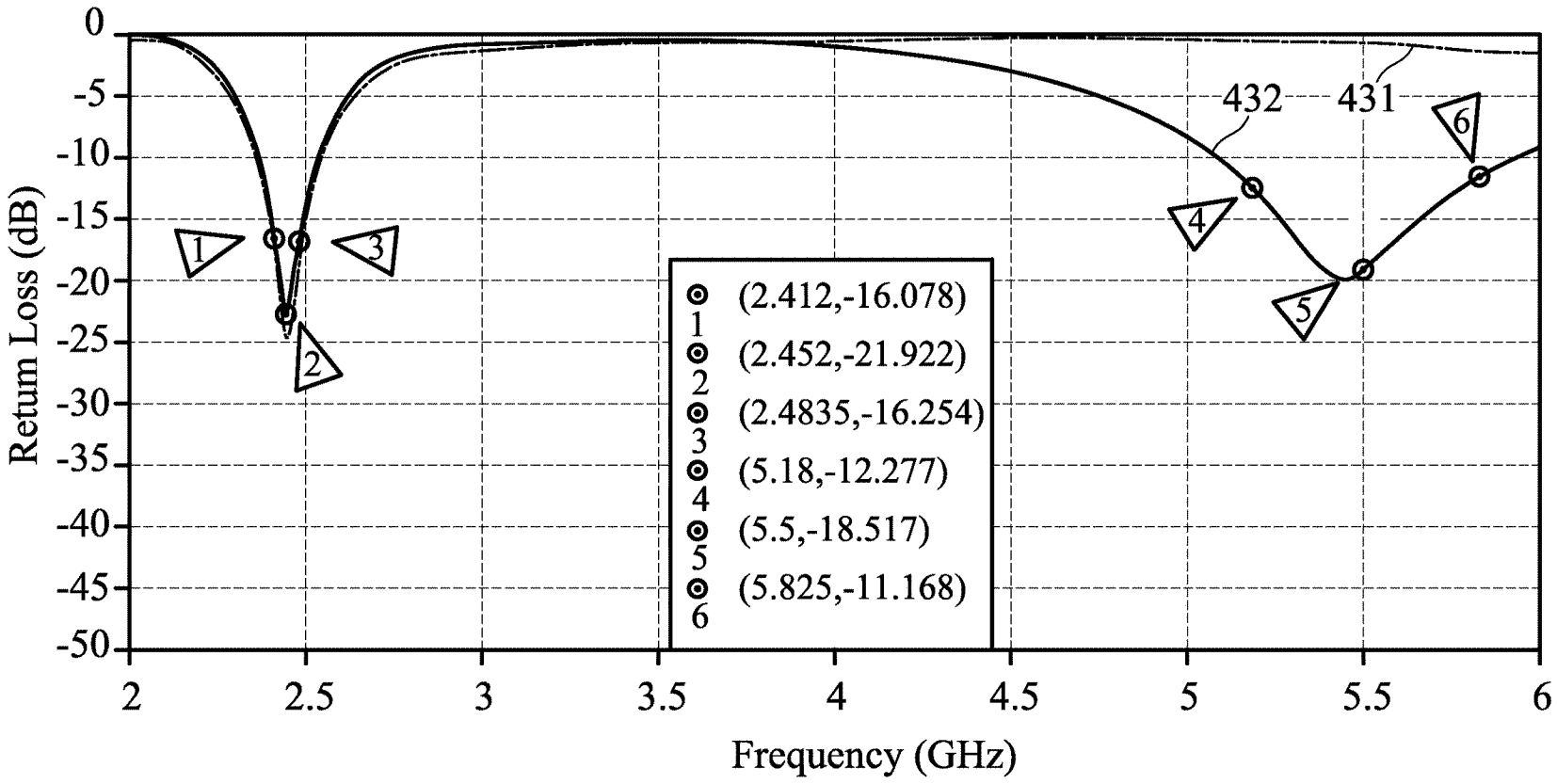
FIG. 4B is a simulation showing the return loss of the Bluetooth antenna 410 and the dual-band antenna 320 of the antenna apparatus 40 disclosed in the fourth embodiment.

FIG. 4B is a simulation showing the return loss of the Bluetooth antenna 410 and the dual-band antenna 320 of the antenna apparatus 40 disclosed in the fourth embodiment, wherein the X-axis represents operation frequency and the Y-axis represents the magnitude of return loss in dB. In FIG. 4B, line 431 shows the return loss of the Bluetooth antenna 410, and line 432 shows the return loss of the dual-band antenna 320.

According to the simulation results, the Bluetooth antenna 410 has well performance at 2.3 GHz~2.8 GHz. Hence the Bluetooth antenna 410 can be used to transmit/receive radio signals of the first frequency (2.4 GHz). According to the simulation results, when the operation frequencies are respectively at 2.412 GHz, 2.452 GHz, and 2.4835 GHz, the return loss of the dual-band antenna 320 are respectively −16.078 dB, −21.922 dB, and −16.254 dB. When the operation frequencies are respectively at 5.18 GHz, 5.5 GHz, and 5.825 GHz, the return loss of the dual-band antenna 320 are respectively −12.277 dB, −18.517 dB, and −11.168 dB. Hence the dual-band antenna 320 can be used to transmit/receive radio signals of the first frequency (2.4 GHz) and the second frequency (5 GHz).

While the present invention has been described by way of example and in terms of preferred embodiment, it is to be understood that the present invention is not limited thereto. On the contrary, it is intended to cover various modifications and similar arrangements (as would be apparent to a person skilled in the art). Therefore, the scope of the appended claims should be accorded the broadest interpretation so as to encompass all such modifications and similar arrangements.

What is claimed is:

1. An antenna apparatus, comprising:

a first antenna array, comprising multiple first radiating elements, disposed on a substrate for transmitting/receiving radio signals of a first frequency; and a second antenna array, comprising multiple second radiating elements, disposed on the substrate for transmitting/receiving radio signals of a second frequency, wherein the first radiating elements and the second radiating elements are arranged in a staggered manner; and a dual-band antenna disposed on the substrate for transmitting/receiving the radio signals of the first frequency and the second frequency, wherein the dual-band antenna is enclosed by the first and second radiating elements, wherein each of the first radiating elements is disposed between two of the second radiating elements, and wherein each of the second radiating elements is disposed between two of the first radiating elements.

2. The antenna apparatus of claim 1, further comprising:

a Bluetooth antenna disposed on the substrate for transmitting/receiving the radio signals of the first frequency, wherein the Bluetooth antenna is enclosed by the first and second radiating elements.

3. The antenna apparatus of claim 2, wherein the number of the first radiant elements is four, and the number of the second radiant elements is four; and wherein the first and second radiating elements are arranged in a rectangular shape, and each two of the first and second radiating elements are disposed on each side of the rectangular shape.

4. The antenna apparatus of claim 3, wherein the orientation of the first radiating element is substantially perpendicular to the orientations of two adjacent first radiating elements;

wherein the orientation of the second radiating element is substantially perpendicular to the orientations of two adjacent second radiating elements; and wherein the orientation of the dual-band antenna is substantially perpendicular to the orientation of Bluetooth antenna.

5. The antenna apparatus of claim 3, wherein the first radiating elements are disposed at each corner of the rectangular shape.

6. An antenna apparatus, comprising:

a first antenna array, comprising multiple first radiating elements, disposed on a substrate for transmitting/receiving radio signals of a first frequency;

a second antenna array, comprising multiple second radiating elements, disposed on the substrate for transmitting/receiving radio signals of a second frequency;

a Bluetooth antenna disposed on the substrate for transmitting the radio signals of the first frequency; and a dual-band antenna disposed on the substrate for transmitting the radio signals of the first frequency and the second frequency, wherein the first radiating elements and the second radiating elements are disposed around the Bluetooth antenna and the dual-band antenna.

7. The antenna apparatus of claim 6, wherein the number of the first radiant elements is four, and the number of the second radiant elements is four; and wherein the first and second radiating elements are arranged in a rectangular shape, and each two of the first and second radiating elements are disposed on each side of the rectangular shape.

8. The antenna apparatus of claim 6, wherein the distance between the first radiating element and the corresponding nearest second radiating element is less than the smallest distance of any two of the first radiating elements.

9. The antenna apparatus of claim 6, wherein the orientation of the first radiating element is substantially perpendicular to the orientations of two adjacent first radiating elements;

wherein the orientation of the second radiating element is substantially perpendicular to the orientations of two adjacent second radiating elements; and wherein the orientation of the dual-band antenna is substantially perpendicular to the orientation of Bluetooth antenna.

10. The antenna apparatus of claim 7, wherein the first radiating elements are disposed at each corner of the rectangular shape.

11. A multi-input multi-output (MIMO) communication device, comprising:

a signal processing unit for processing baseband signals; and a transceiver coupled to the signal processing unit, for processing the baseband signals and generating radio signals, wherein the transceiver comprises an antenna apparatus for transmitting/receiving the radio signals, and wherein the antenna apparatus comprising:

a grounding plate;

a substrate disposed on the grounding plate;

a first antenna array, comprising multiple first radiating elements, disposed on the substrate for transmitting/receiving radio signals of a first frequency;

a second antenna array, comprising multiple second radiating elements, disposed on the substrate for transmitting/receiving radio signals of a second frequency, wherein the first radiating elements and the second radiating elements are arranged in a staggered manner; and a dual-band antenna disposed on the substrate for transmitting the radio signals of the first frequency and the second frequency, wherein the dual-band antenna is enclosed by the first and second radiating elements, wherein each of the first radiating elements is disposed between two of the second radiating elements, and wherein each of the second radiating elements is disposed between two of the first radiating elements.

12. The MIMO communication device of claim 11, wherein the antenna apparatus further comprising:

a Bluetooth antenna disposed on the substrate for transmitting/receiving the radio signals of the first frequency, wherein the Bluetooth antenna is enclosed by the first and second radiating elements.

13. The MIMO communication device of claim 12, wherein the number of the first radiant elements is four, and the number of the second radiant elements is four; and wherein the first and second radiating elements are arranged in a rectangular shape, and each two of the first and second radiating elements are disposed on each side of the rectangular shape.

14. The MIMO communication device of claim 13, wherein the orientation of the first radiating element is substantially perpendicular to the orientations of two adjacent first radiating elements;

wherein the orientation of the second radiating element is substantially perpendicular to the orientations of two adjacent second radiating elements; and wherein the orientation of the dual-band antenna is substantially perpendicular to the orientation of Bluetooth antenna.

15. The MIMO communication device of claim 13, wherein the first radiating elements are disposed at each corner of the rectangular shape.

* * * * *